US008231559B2

(12) United States Patent
Nakao et al.

(10) Patent No.: US 8,231,559 B2
(45) Date of Patent: Jul. 31, 2012

(54) PNEUMATIC MASSAGE DEVICE

(75) Inventors: Haruki Nakao, Tokyo (JP); Hiroki Kawashima, Tokyo (JP)

(73) Assignee: Nitto Kohki Co., Ltd., Tokyo (JP)

( * ) Notice: Subject to any disclaimer, the term of this patent is extended or adjusted under 35 U.S.C. 154(b) by 865 days.

(21) Appl. No.: 12/308,983

(22) PCT Filed: Jul. 2, 2007

(86) PCT No.: PCT/JP2007/063224

§ 371 (c)(1),
(2), (4) Date: Dec. 31, 2008

(87) PCT Pub. No.: WO2008/004516

PCT Pub. Date: Jan. 10, 2008

(65) Prior Publication Data

US 2009/0240179 A1 Sep. 24, 2009

(30) Foreign Application Priority Data

Jul. 3, 2006 (JP) ..... 2006-183672

(51) Int. Cl.
*A61H 7/00* (2006.01)

(52) U.S. Cl. ..... 601/151; 601/148; 601/149

(58) Field of Classification Search ..... 601/148, 601/149, 150, 151, 152, DIG. 20; 602/13; 606/201, 202

See application file for complete search history.

(56) References Cited

U.S. PATENT DOCUMENTS 2,245,909 A * 6/1941 Enfiajian ..... 5/710
2,781,041 A * 2/1957 Weinberg ..... 601/149
2,896,612 A * 7/1959 Bates et al. ..... 601/149
3,862,629 A * 1/1975 Rotta ..... 601/150
4,029,087 A * 6/1977 Dye et al. ..... 601/152

(Continued)

FOREIGN PATENT DOCUMENTS

EP 1 864 639 12/2007

(Continued)

OTHER PUBLICATIONS

International Search Report issued Jul. 31, 2007 in International (PCT) Application PCT/JP2007/063224.

(Continued)

*Primary Examiner* — Justine Yu
*Assistant Examiner* — Raymond G Chen
(74) *Attorney, Agent, or Firm* — Wenderoth, Lind & Ponack, L.L.P.

(57) ABSTRACT

A light-weight pneumatic massage apparatus with low operation noise is provided. This apparatus includes a pneumatic massage device and a pump separated from the massage device. The apparatus further includes electromagnetic valves for controlling supply and discharge of pressurized air to and from air chambers of the pneumatic massage device, respectively. Each of the electromagnetic valves includes a displaceable valve member having an armature, and a solenoid for attracting the armature to move the displaceable valve member when a voltage is applied to the solenoid. The apparatus further includes an electromagnetic valve control unit which controls a voltage supplied to the solenoid to open the electromagnetic valves such that the voltage increases from gradually with the passage of time. The armature is attracted onto the end surface of the solenoid within the time period. Then, in a state in which the voltage is reduced to, the armature is maintained attracted onto the solenoid to keep the open state. After that, voltage supply is stopped to close the valve.

8 Claims, 5 Drawing Sheets

U.S. PATENT DOCUMENTS

| | | | | |
|---|---|---|---|---|
| 4,066,084 | A * | 1/1978 | Tillander | 606/202 |
| 4,156,425 | A * | 5/1979 | Arkans | 601/152 |
| 4,311,135 | A * | 1/1982 | Brueckner et al. | 601/152 |
| 4,320,746 | A * | 3/1982 | Arkans et al. | 601/152 |
| 4,577,626 | A * | 3/1986 | Marukawa et al. | 601/150 |
| 4,583,522 | A * | 4/1986 | Aronne | 600/20 |
| 5,052,377 | A * | 10/1991 | Frajdenrajch | 601/152 |
| 5,109,832 | A * | 5/1992 | Proctor et al. | 601/149 |
| 5,186,163 | A * | 2/1993 | Dye | 601/27 |
| 5,383,842 | A * | 1/1995 | Bertini | 601/151 |
| 5,681,026 | A * | 10/1997 | Durand | 251/129.16 |
| 5,938,628 | A * | 8/1999 | Oguri et al. | 601/150 |
| 6,355,008 | B1 * | 3/2002 | Nakao | 601/150 |
| 6,629,941 | B1 | 10/2003 | Ishibashi et al. | |
| 7,044,924 | B1 * | 5/2006 | Roth et al. | 601/151 |
| 7,063,676 | B2 * | 6/2006 | Barak et al. | 601/150 |
| 7,270,642 | B2 * | 9/2007 | Ouchene et al. | 601/151 |
| 2002/0107461 | A1 * | 8/2002 | Hui | 601/149 |
| 2005/0027221 | A1 * | 2/2005 | Calderon et al. | 602/13 |

FOREIGN PATENT DOCUMENTS

| | | |
|---|---|---|
| GB | 2 452 450 | 3/2009 |
| JP | 49-28193 | 3/1974 |
| JP | 6-207684 | 7/1994 |
| JP | 9-84841 | 3/1997 |
| JP | 10-295752 | 11/1998 |
| JP | 2000-189477 | 7/2000 |
| JP | 2000-266219 | 9/2000 |
| JP | 2004-378 | 1/2004 |
| JP | 2006-37970 | 2/2006 |
| JP | 2006-115891 | 5/2006 |

OTHER PUBLICATIONS

Great Britain Office Action issued Sep. 27, 2010 in Application No. GB0823671.3.

* cited by examiner

PNEUMATIC MASSAGE DEVICE

BACKGROUND OF THE INVENTION

I. Technical Field

The present invention relates to a pneumatic massage apparatus which has a plurality of air chambers, and which provides a massage effect while expanding and contracting the air chambers by controllably supplying and discharging pressurized air thereto and therefrom.

II. Description of the Related Art

Generally, a pneumatic massage apparatus has a plurality of air chambers, and provides a massage effect while expanding and contracting the air chambers by supplying pressurized air from a pump to the air chambers and discharging the pressurized air from the air chambers. Supply and discharge of pressurized air is controlled by means of an electromagnetic valve using a solenoid. In the electromagnetic valve, a voltage is applied to the solenoid to attract an armature attached to a displaceable valve member, whereby the displaceable valve is moved to open and close the electromagnetic valve. Therefore, the armature is attracted to and hits against the solenoid, which causes impact noise. In view of the intended use of pneumatic massage apparatuses, it is desirable that such impact noise be reduced as much as possible (see Japanese Unexamined Patent Application Publication No. 2000-189477).

As a countermeasure against such impact noise, a method in which cushioning material is provided at the end surface of the solenoid against which the armature hits is known in conventional electromagnetic valves.

SUMMARY OF THE INVENTION

However, although such a method using cushioning material has a silencing effect, the armature should be disposed apart from the solenoid by the thickness of the cushioning material, which reduces an attracting force of the solenoid with respect to the armature. In order to obtain an attracting force that is the same as that in an electromagnetic valve without a cushioning material, it is necessary to use a larger solenoid and to increase an applied voltage.

Further, in a pneumatic massage apparatus which in use is worn around the upper limbs and the lower limbs of a human body, it is desirable to reduce the impact sound as well as to reduce the size and weight of the electromagnetic valve for comfortable use.

In view of the forgoing, it is an object of the present invention to provide a user-friendly pneumatic massage apparatus that is light in weight and has low operation noise, by using smaller and lighter electromagnetic valves in which impact noise is reduced.

The present invention provides a pneumatic massage apparatus including a pneumatic massage device having a plurality of air chambers and making an effect on a human body that are expanded and contracted by supplying and discharging pressurized air thereto and therefrom to thereby make an effect on a human body, and a pump separated from the pneumatic massage device and supplying pressurized air to the air chambers. The pneumatic massage apparatus further includes electromagnetic valves which are provided for the respective air chambers and control supply and discharge of pressurized air to and from the respective air chambers, and each of which has a displaceable valve member with an armature and a solenoid for attracting the armature to move the displaceable valve member when a voltage is applied to the solenoid; and an electromagnetic valve control unit controlling the electromagnetic valves and being configured to gradually increase voltages applied to the solenoids to open or close the electromagnetic valves. Here, "gradually increase with the passage of time" basically means continuous change. However, for example, even in a case where a voltage is digitally increased in steps, such an increase is also included in the above meaning if the voltage is generally continuously changed.

In this pneumatic massage apparatus, applied voltage to the solenoid is increased gradually with the passage of time. Therefore, in comparison with a conventional apparatus in which a voltage of the final value is applied to the solenoid from the beginning, it is possible to reduce kinetic energy of the armature attracted by the solenoid. As a result, impact noise can be reduced. Further, even in a case where the clearance between the armature and the solenoid has a manufacturing tolerance, or a case where a friction resistance against the displaceable valve member varies, it is possible to surely attract the armature regardless of individual differences in electromagnetic valves, by predetermining the final voltage value in consideration of such a tolerance and such a friction resistance.

Furthermore, in comparison with a case where cushioning material is used for noise reduction in a conventional apparatus, the solenoid can be smaller and lighter, whereby the electromagnetic valve can be smaller and lighter. Thus, it is possible to reduce the weight of the pneumatic massage apparatus.

In the present invention, after the opening or closing operation of the electromagnetic valve, it is possible to maintain a voltage applied to the solenoid at a given voltage value so as to maintain the open or close state of the electromagnetic valve. This voltage value is determined on the basis of conditions for maintaining the close state.

Preferably, the given voltage value should be less than the final voltage value applied for the opening or closing operation. This is because of the following reason. An attracting force of the solenoid with respect to the armature increases exponentially as the armature comes close to the solenoid. In a state in which the armature is attracted to and contacted with the solenoid, it is possible to maintain the contact state by an attracting force much smaller than that used for bringing the armature into contact with the solenoid. In this way, it is possible to suppress power consumption and heat generation of the solenoid.

By "after the opening or closing operation of the electromagnetic valve", it is meant that the electromagnetic valve has completed the opening or closing operation. For example, a sensor or the like may be used to detect that the opening or closing operation is completed. Alternatively, the completion of the opening or closing operation may be detected by detecting a time period or a voltage value necessary for completing the opening or closing operation, instead of by directly detecting the opening or closing operation.

Specifically, the pneumatic massage device is configured to be worn around the upper limbs or the lower limbs of a human body in a tubular manner, the air chambers are arranged successively along a longitudinal direction of the tubular pneumatic massage device, the pneumatic massage device has a hose disposed so as to extend along the longitudinal direction and configured to receive at one end thereof pressurized air from the pump, and the electromagnetic valves are attached to the pneumatic massage device between the respective air chambers and the hose.

To improve usability, the electromagnetic valves may be attached on the side of the pump instead of the side of the pneumatic massage device worn around the upper and lower limbs. In the present invention, however, the electromagnetic valves are attached to the pneumatic massage device since impact noise of the electromagnetic valves can be reduced. With this arrangement, a passage through which air is discharged from the air chamber via the electromagnetic valve can be shorter, whereby it is possible to reduce a flow passage and to operate the pneumatic massage device effectively.

Specifically, the electromagnetic valve control unit is configured to be able to control the electromagnetic valves to supply and discharge pressurized air to and from preselected air chambers.

In this way, the pneumatic massage apparatus can be used such that only necessary air chambers are expanded and contracted according to the lengths of the upper limbs and the lower limbs of a user. Therefore, it is not necessary to prepare different kinds of pneumatic massage apparatuses according to the lengths of the upper limbs and the lower limbs of a user.

More specifically, the electromagnetic valves are disposed at respective positions corresponding to the air chambers arranged successively along the longitudinal direction of the hose, respectively. Each of the electromagnetic valves includes a tubular housing which has a longitudinal axis extending in the longitudinal direction of the hose and which has at one end of the longitudinal axis an air inlet (corresponding to a pump communication port 64 of an electromagnetic valve in FIG. 3, and a first opening 54 of an electromagnetic valve in FIG. 6, in the embodiments described below) connected to the hose, at an other end an air outlet (corresponding to a second opening 56 of the electromagnetic valves in FIGS. 3 and 6 in the embodiments) open to the atmosphere, and on a side wall surface of the tubular housing a supply/discharge port (corresponding to a third opening 58 in the electromagnetic valve) connected to the air chamber corresponding to the electromagnetic valve. The supply/discharge port is selectively communicated with the air inlet or the air outlet by the opening and closing operation of the electromagnetic valve. Connectors are provided for fluidly communicating the hose and the air inlets of the electromagnetic valves. At least one of the connectors may have a T-shaped connector having a base portion connected, at an intermediate position between adjacent electromagnetic valves in the longitudinal direction of the hose, to the hose and extending in a direction perpendicular to the hose, and branch portions extending from a distal end of the base portion in opposite directions in the longitudinal direction of the hose and connected to the air inlets of the adjacent electromagnetic valves which are arranged opposite to each other.

In this case, the electromagnetic valves are arranged such that a plurality of pairs of adjacent electromagnetic valves are arranged along the longitudinal direction of the hose, the adjacent electromagnetic valves of each pair are arranged such that air inlets thereof face to each other, and thus the air inlets of each pair of electromagnetic valves can be connected to the hose by means of the T-shaped connector.

In this arrangement of the electromagnetic valves, the hose and the electromagnetic valves are connected by means of the T-shaped connectors. As a result, it is possible to reduce the number of openings provided in the hose for connection, whereby the electromagnetic valves can be efficiently arranged.

The present invention also provides a pneumatic massage apparatus including a pneumatic massage device having a plurality of air chambers that are expanded and contracted by supplying and discharging pressurized air thereto and therefrom thereby making an effect on a human body and a pump separated from the pneumatic massage device and supplying pressurized air to the air chambers. The pneumatic massage device is configured to be worn around the upper limbs or the lower limbs of a human body in a tubular manner. The air chambers are arranged successively along the longitudinal direction of the tubular pneumatic massage device. The pneumatic massage device includes a hose disposed so as to extend along the longitudinal direction and configured to receive at one end thereof pressurized air from the pump. The pneumatic massage device further includes electromagnetic valves which are disposed at respective positions corresponding to the air chambers arranged successively along the longitudinal direction of the hose and which control supply and discharge of the pressurized air to and from the air chambers and each of which has a displaceable valve member with an armature and a solenoid for attracting the armature to move the displaceable valve member when a voltage is applied to the solenoid.

In this apparatus, the hose and the electromagnetic valves are arranged and attached with respect to the air chambers of the pneumatic massage device as described above. Therefore, it is possible to prevent the massage device which in use is worn around the upper limbs or the lower limbs from being bulky, which provides better usability.

Specifically, each of the electromagnetic valves includes a tubular housing which has a longitudinal axis extending in the longitudinal direction of the hose and which has at one end of the longitudinal axis an air inlet (corresponding to a pump communication port 64 of an electromagnetic valve in FIG. 3, and a first opening 54 of an electromagnetic valve in FIG. 8, in the embodiments described below) connected to the hose, at the other end an air outlet (corresponding to a second opening 56 in the embodiments) open to the atmosphere, and on a side wall of the tubular housing a supply/discharge port (corresponding to a third opening 58 in the embodiments) connected to the air chamber corresponding to the electromagnetic valve. The supply/discharge port is selectively communicated with the air inlet or the air outlet by the opening and closing operation of the electromagnetic valve. The side wall of the tubular housing has a tubular connecting protrusion protruding toward an outside of the tubular housing and defining the supply/discharge port. The tubular connecting protrusion is inserted into and secured to a wall defining the corresponding air chamber to connect the supply/discharge port to the air chamber.

In this case, the electromagnetic valve is connected directly to the corresponding air chamber, which provides efficient arrangement and attachment of the hose and the electromagnetic valve with respect to the air chamber in terms of space saving. In comparison with a case where a hose or the like is provided between the electromagnetic valve and the air chamber to connect them, it is possible to reduce resistance to pressurized air when the air is supplied and discharged. Further, since such extra components are eliminated, it is possible to prevent breakdown and the like.

More specifically, connectors are provided for fluidly communicating the hose and the air inlets of the electromagnetic valves. At least one of the connectors may be configured to be a T-shaped connector which has a base portion connected, at an intermediate position between adjacent electromagnetic valves in the longitudinal direction of the hose, to the hose and extending in a direction perpendicular to the hose, and branch portions extending from the distal end of the base portion in opposite directions in the longitudinal direction of the hose and connected to the air inlets of the adjacent electromagnetic valves which are arranged opposite to each other.

Such a T-shaped connector provides further efficient arrangement and attachment of the electromagnetic valves and the hose.

For further efficiency, the electromagnetic valves are arranged such that a plurality of pairs of adjacent electromagnetic valves are arranged along the longitudinal direction of the hose, the adjacent electromagnetic valves of each pair are arranged such that air inlets thereof face to each other, and thus the air inlets of each pair of electromagnetic valves can be connected to the branch portions of the T-shaped connector, respectively.

Furthermore, the tubular housings of the electromagnetic valves are aligned along a line parallel to the hose, whereby the massage device can be less bulky and more convenient for use.

As described above, the present invention can provide a pneumatic massage apparatus with low operation noise. Further, it is possible to efficiently arrange and connect the electromagnetic valves and the hose with respect to the pneumatic massage device.

DETAILED DESCRIPTION OF THE INVENTION

A pneumatic massage apparatus 10 according to an embodiment of the present invention will now be described with reference to the accompanying drawings.

Figure 1:
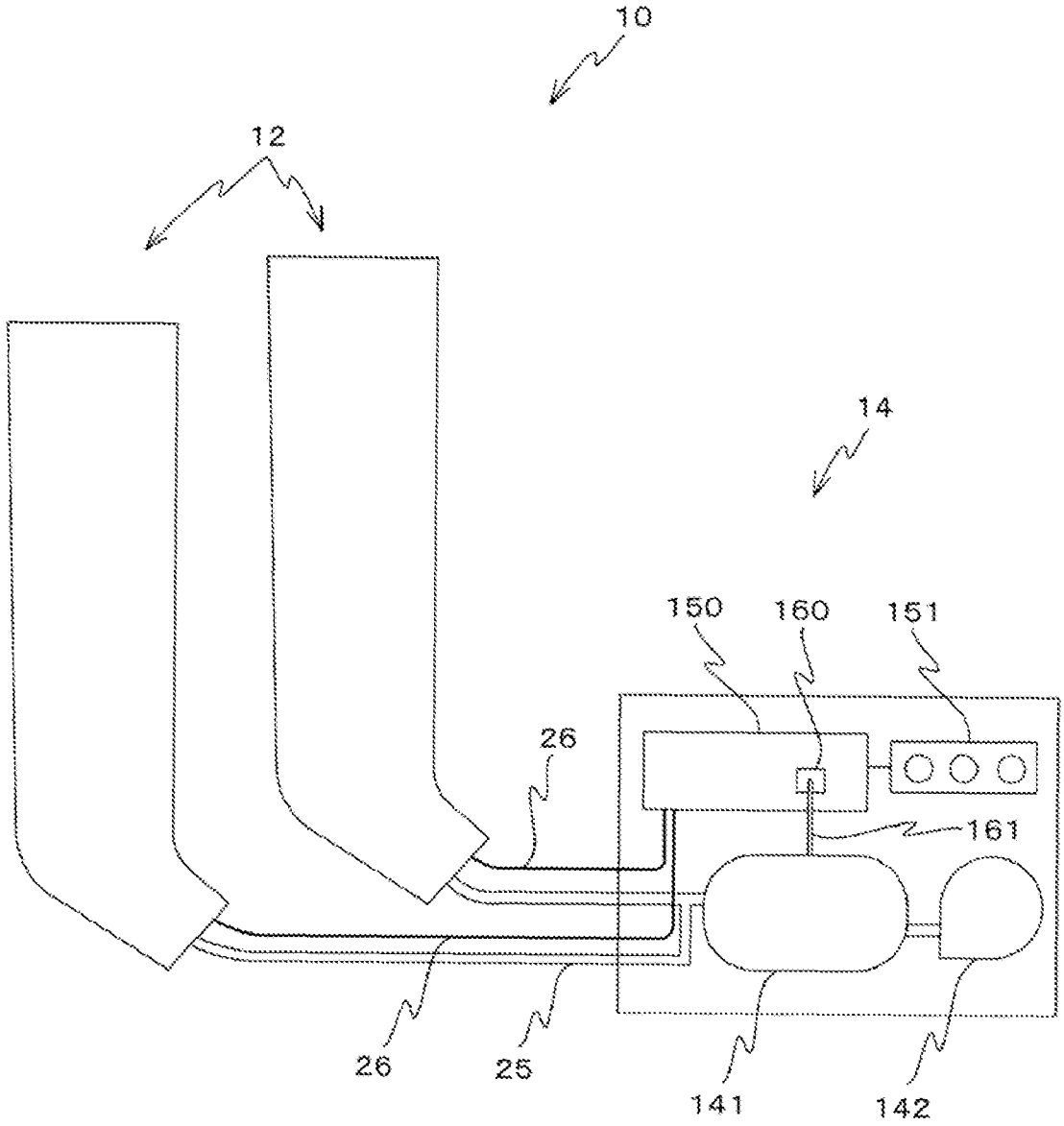
FIG. 1 is a schematic diagram of a pneumatic massage apparatus 10 according to an embodiment of the present invention.

As shown in FIG. 1, the pneumatic massage apparatus 10 includes a pair of massage devices 12 which are worn around the left and right lower limbs of a user, and a massage apparatus main unit 14 which is placed on a floor or the like adjacent to the user wearing the massage devices. The massage devices 12 and the massage apparatus main unit 14 are connected through a pressurized air supply hose 25 and a plurality of control signal lines 26.

The massage apparatus main unit 14 includes a tank 141 for maintaining pressurized air in a stable state, a pump 142 for feeding air to the tank 141, a control unit 150 for mainly controlling the operation of each electromagnetic valve, and an operation panel 151 by which a user or the like gives instructions for operation of the pneumatic massage apparatus 10. The control unit 150 is provided with a pressure sensor 160 to measure pressure inside the tank 141 through a hose 161. The hose 25 is connected to the tank 141, and the control signal lines 26 are connected to the control unit 150.

Figure 2:
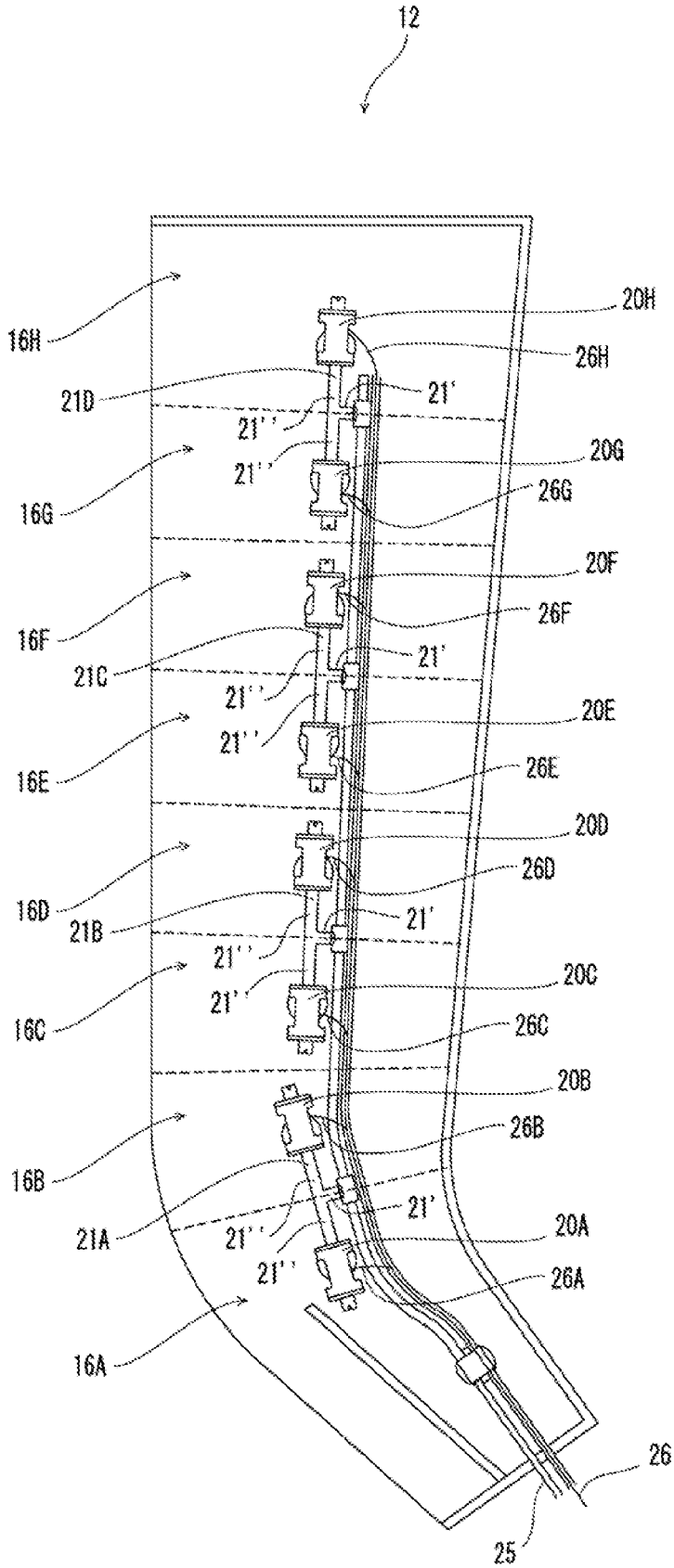
FIG. 2 is a schematic diagram of a massage device 12 in FIG. 1.

FIG. 2 schematically shows the massage device 12. The inside of the massage device 12 is divided into eight air chambers 16A to 16H. The air chambers are expanded and contracted by supplying and discharging pressurized air to and from the air chambers, whereby the massage device provides a massaging effect on a user. Electromagnetic valves 20A to 20H are provided for the air chambers, respectively. As shown in the figure, pairs of electromagnetic valves for respective pairs of two adjacent air chambers are connected to the hose 25 through respective T-shaped connectors 21A to 21D. Specifically, each of these T-shaped connectors has a base portion 21' connected to the hose 25 and extending laterally from the hose 25, and branch portions 21" extending from the distal end of the base portion 21' in opposite directions in a direction in which the hose extends. The branch portions are connected to respective adjacent electromagnetic valves.

Figure 3:
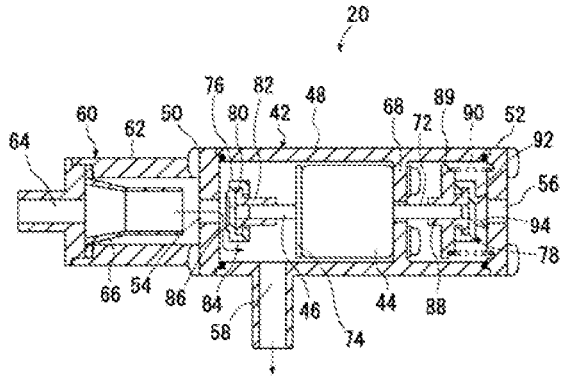
FIG. 3 is a sectional view of a three-way electromagnetic valve used in the massage device 12 in FIG. 1, showing a state in which pressurized air is supplied from a pump.

FIG. 3 schematically shows the structure of the electromagnetic valve 20 to be attached to the massage device 12 as the electromagnetic valves 20A to 20H. The electromagnetic valve 20 has a tubular housing 42, a solenoid 44 disposed in the housing, a displaceable valve member 46 disposed in the housing 42 and being displaceable in an axial direction of the housing by the action of the solenoid. The housing 42 has a tubular wall 48, a first end wall 50, and a second end wall 52. The first end wall 50, the second end wall 52, and the tubular wall 48 are provided with a first opening 54, a second opening 56, and a third opening 58, respectively, penetrating therethrough. In the illustrated example, a check valve 60 is attached to the first end wall 50 of the housing 42, and the first opening 54 is configured to communicate with the pump through the check valve 60. The check valve 60 has a tubular housing 62 coaxially connected to the housing 42, and a conical check valve member 66 made of flexible material such as rubber and coaxially attached to a pump communication port 64 provided at the end surface of the tubular housing 62.

As shown in FIG. 2, the pump communication port 64 is connected to any one of the connectors 21A to 21D and thus communicates with the pump 142 of the massage apparatus. The third opening 58 communicates with any one of the air chambers 16A to 16H which expand and contract by supplying pressurized air from the pump to the air chambers and discharging the pressurized air from the air chambers, and the second opening 56 is open to the atmosphere.

The housing 42 has an annular solenoid retaining wall 68 formed on the inner surface of the tubular wall 48, and the solenoid 44 is secured to the solenoid retaining wall so as to be coaxial with the housing 42. The solenoid retaining wall 68 is provided with an air passage (not shown) passing therethrough in the axial direction of the housing.

The displaceable valve member 46 has a rod 72 extending through a through hole extending along an axis of the solenoid, a disc-shaped armature 74 made of magnetic material such as steel and secured to the rod 72 on the side of the first opening 54 with respect to the solenoid 44, a first valve member 76 disposed at one end of the rod 72, and a second valve member 78 disposed at the other end of the rod 72. The first valve member 76 has a tubular valve member holding member 82 engaging with the one end of the rod 72 and having at the left end thereof a flange 80, and a generally disk-shaped valve member 84 engaging with the flange 80 and made of elastomeric material such as rubber. The valve member 84 has a valve seat engaging portion 86 annularly protruding from a surface thereof facing to the first opening 54 and having a generally semicircular-shaped cross section in the radial direction. The second valve member 78 has a valve member holding member 88 similar to the valve member holding member 82 of the first valve member 76. The valve member holding member 88 is provided with a spring retaining portion 89 which retains a compression spring 90 against the second end wall 52, thereby biasing the displaceable valve member 46 against the first end wall. The second valve member 78 also has a valve member 92 similar to the valve member 84 of the first valve member 76. The valve member 92 is provided, on a surface thereof facing to the second end wall 52, with a conical valve seat engaging portion 94 radially outwardly extending toward the second end wall 52. The check valve member 60 prevents pressurized air from flowing from the air chamber back to the side of the pump.

The operation of the pneumatic massage apparatus 10 will now be described.

A user of the pneumatic massage apparatus 10 wears the pneumatic massage apparatus 10 around the lower limbs of the user. If the pneumatic massage apparatus is too long, the user operates the operation panel 151 to preset the air chamber 16H or the air chambers 16H and 16G, which are not used according to the length of the lower limbs of the user, and then gives an instruction to start the operation of the pneumatic massage apparatus 10.

After receiving the instruction of starting operation from the operation panel 151, the control unit 150 gives an instruction for operation to the electromagnetic valves 20 except ones corresponding to the air chamber 16H or the air chambers 16H, 16G which are set not to be used by means of the operation panel 151. In other words, the control unit 150 controls supply and discharge of pressurized air by periodically applying a voltage to the solenoids 44 of the to-be-used electromagnetic valves 20, thereby expanding and contracting the corresponding air chambers. On the other hand, the control unit 150 does not apply a voltage to the not-to-be-used electromagnetic valves to maintain the corresponding air chambers contracted. Therefore, it is possible to use the pneumatic massage apparatus with its length shortened by, for example, folding back the not-to-be-used air chamber portion.

Figure 4:
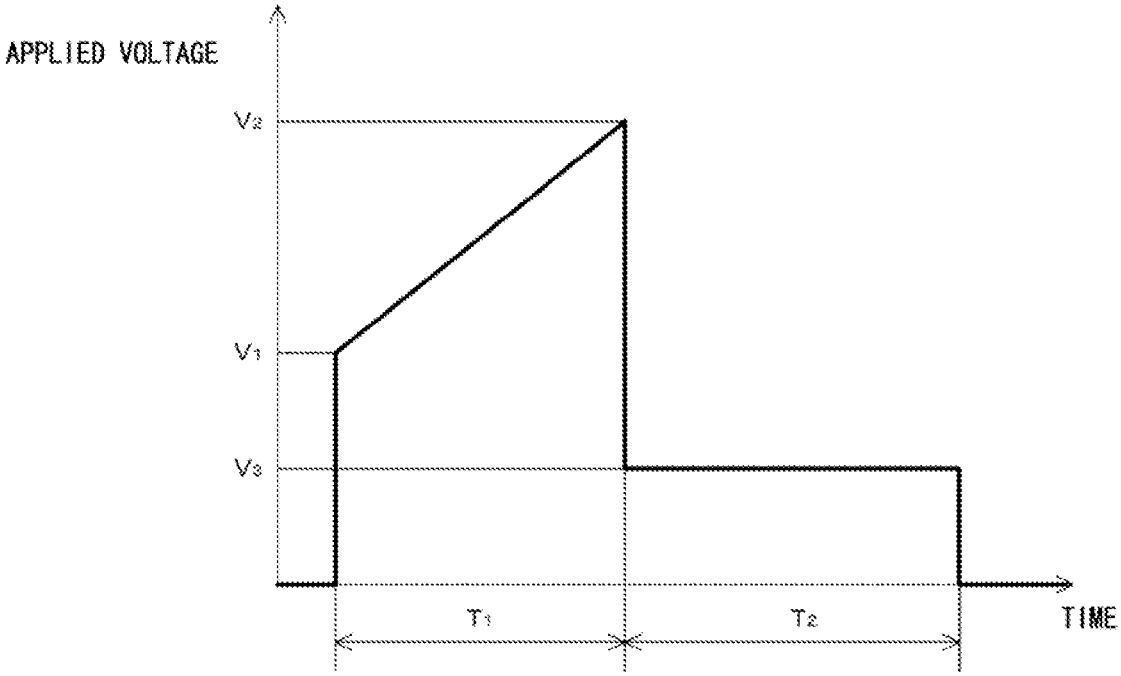
FIG. 4 is a graph showing changes in voltage applied to a solenoid by means of a control unit 150.

As shown in a graph of applied voltage in FIG. 4, when supplying pressurized air, the control unit 150 first applies a voltage of a given voltage value $V_1$ to the solenoid 44, and then continuously increases the voltage to a voltage value $V_2$ over a time period $T_1$. The armature 74 is attracted onto the end surface of the solenoid 44 within the time period $T_1$. After a lapse of the time period $T_1$, the control unit 150 reduces the applied voltage to a given voltage value $V_3$, and then maintains the voltage at the value $V_3$ for a time period $T_2$ during which pressurized air is supplied to the air chamber. The voltage value $V_3$ is a value necessary for maintaining the armature 74 attracted onto the end surface of the solenoid 44. An attracting force of the solenoid 44 with respect to the armature 74 increases exponentially as the armature comes close to the end surface of the solenoid. Therefore, in a state in which the armature is in contact with the end surface of the solenoid, it is possible to maintain the contact state by means of an attracting force much smaller than that necessary for attracting the armature into contact with the solenoid.

In this way, since the solenoid 44 attracts the armature 74 while gradually increasing the attracting force to the armature 74. Therefore, in comparison with a case where the voltage $V_2$ is applied from the beginning, an impact force of the armature 74 against the solenoid 44 is smaller, whereby it is possible to reduce impact noise. Further, the position of the armature 74 is maintained after the applied voltage is reduced to the given voltage value, whereby it is possible to suppress power consumption and temperature rise of the solenoid 44.

When the armature 74 is attracted toward the end surface of the solenoid 44, the displaceable valve member 46 is moved toward the second end surface as shown in FIG. 3. In this state, the annular valve seat engaging portion 94 of the second valve member 78 is pressed against a valve seat around the second opening 56 while being elastically deformed to close the second opening 56, and the first valve member 76 is moved apart from the first end wall 50 to open the first opening 54. Therefore, in this state, pressurized air is supplied from the pump 142 through the first opening 54 and the third opening 58 to the air chamber 16 of the massage apparatus. This state, i.e., the open state of the first opening, is maintained for the time period $T_2$. However, the check valve 60 prevents pressurized air from flowing from the side of the air chamber through the first opening 54 back to the side of the hose, whereby the pressure of the air which is once supplied to the air chamber 16 is maintained.

Figure 5:
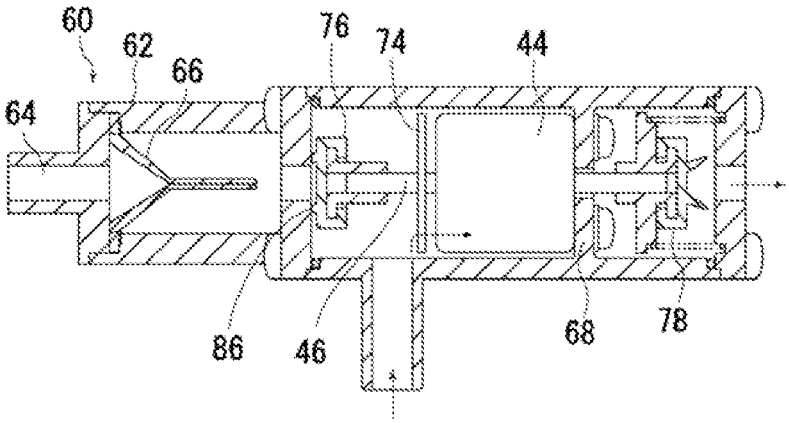
FIG. 5 is a sectional view like FIG. 3, but showing a state in which pressurized air is discharged from an air chamber of the massage device.

After a lapse of the time period $T_2$, i.e., when discharging pressurized air, the control unit 150 stops applying the voltage to the solenoid 44. In this case, as shown in FIG. 5, the displaceable valve member 46 is pressed by the compression spring 90, whereby the valve seat engaging portion 86 of the first valve member 76 is pressed against the first end wall 50 to close the first opening 54 and the second valve member 78 is moved apart from the second end wall 52 to open the second opening 56. Therefore, pressurized air in the air chamber of the massage device is discharged through the third opening 58 and the second opening 56 to the atmosphere.

As can be seen from the above description, with the electromagnetic valve control unit according to this embodiment, it is possible to reduce impact noise without cushioning material or the like which is used in conventional electromagnetic valves. As a result, it is possible to reduce the size and power consumption of the solenoid, whereby the electromagnetic valve can be reduced in size and weight. Thus, the massage apparatus using this electromagnetic valve unit is lightweight, easy to wear, low in power consumption, and convenient to use.

Further, a user can preset the air chamber 16H or the air chambers 16H and 16G, which are not used according to the body of the user, whereby it is not necessary to prepare massage devices with different sizes according to the body of the user.

Furthermore, the T-shaped connectors 21A to 21D are used to connect the hose 25 and the electromagnetic valves, whereby the number of connecting points can be reduced compared with a case where the electromagnetic valves are connected directly to the hose. As a result, it is possible to reduce assembling process and the number of points where air might leak out. It is also possible to increase the number of air chambers (electromagnetic valves) without increasing the number of connection holes of the hose 25. Further, as shown in FIG. 2, the housings of the electromagnetic valves are arranged such that longitudinal axis thereof are aligned along a line parallel to the hose 25. Thus, the pneumatic massage device 12 is prevented from being bulky and is convenient to use.

Although the electromagnetic valves 20 are attached to the massage device 12 in this embodiment, the electromagnetic valves may be included in the massage apparatus main unit 14.

Further, although the three-way electromagnetic valves are used in this embodiment, the present invention may also be applied to other electromagnetic valves such as two-way electromagnetic valves.

Furthermore, although the pneumatic massage apparatus which is worn around the lower limbs is exemplarily described in this embodiment, the present invention may also be applied to other pneumatic massage apparatuses used, for example, as a mat-type bedsores prevention apparatus having a plurality of air chambers.

Figure 6:
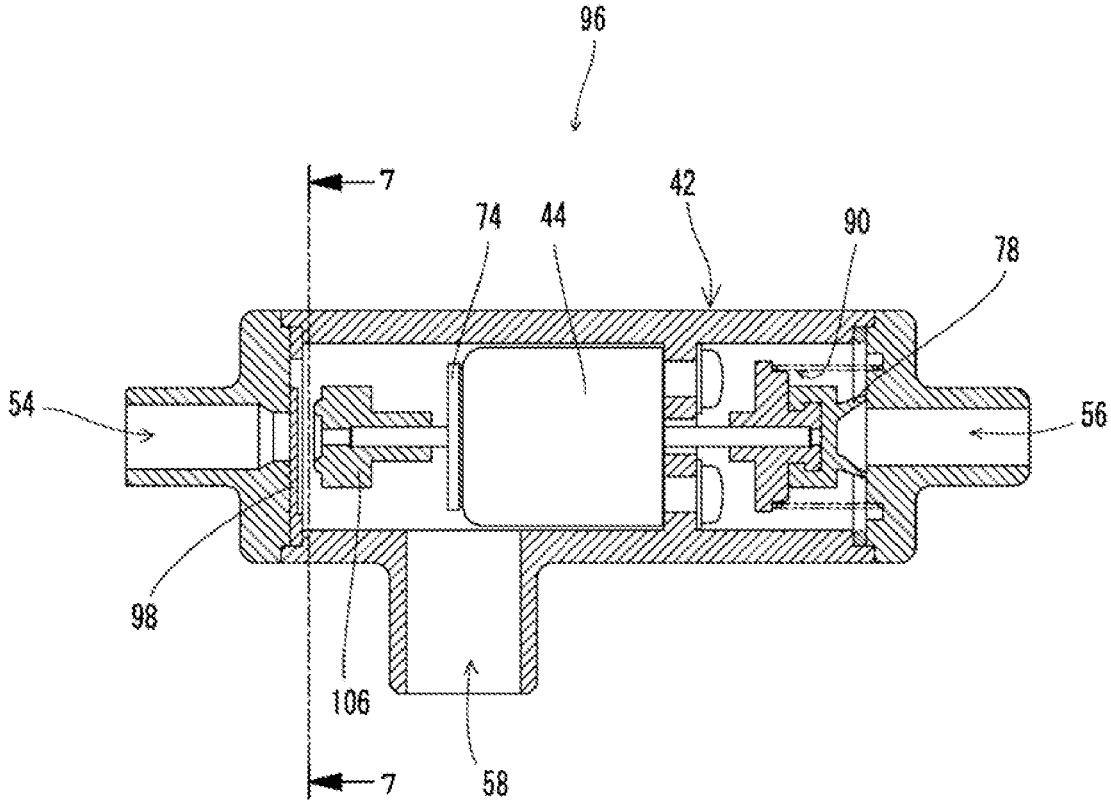
FIG. 6 shows a variation of the electromagnetic valve used in the massage device 12 according to an embodiment of the present invention.

FIG. 6 shows another embodiment of the electromagnetic valve used in the massage device 12 according to the present invention. The same elements as those in the electromagnetic valve in FIG. 3 are denoted by the same reference numerals.

Figure 7:
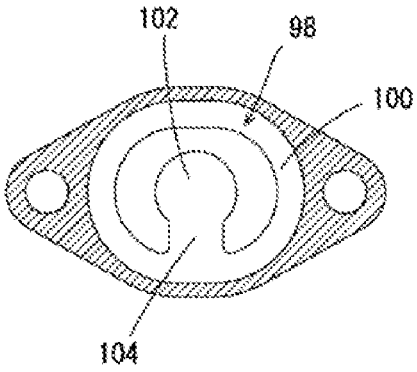
FIG. 7 is a cross-sectional view of FIG. 6 taken along line 7-7.

This electromagnetic valve 96 is similar in the basic structure to that shown in FIG. 3. However, the electromagnetic valve 96 has a valve member 98 attached for opening and closing the first opening 54 of the housing 42 of the electromagnetic valve and formed of an elastic plate-shaped member (specifically, a plate-shaped member made of elastomeric material such as rubber), differently from the structure in which the electromagnetic three-way valve is provided with the check valve 60 as shown in FIG. 3. As shown in FIG. 7, this valve member has an annular portion 100 of which the perimeter portion is sealingly sandwiched between the tubular wall and the end wall of the housing, an opening/closing portion 102 disposed in the center of the annular portion and sealingly engageable with a valve seat (not shown) around the first opening 54, and a connecting portion 104 elastically connecting the opening/closing portion 102 and the annular portion 100. The opening/closing portion 102 is configured to contact with and move apart from the valve seat while pivoting about the connecting portion 104 by bending the connecting portion 104.

In this electromagnetic valve 96, when a voltage is applied to the solenoid 44 and then the armature 74 is attracted onto the end surface of the solenoid 44 as shown in the figure, the valve member 98 acts as a check valve. If the pressure outside the first opening 54 is higher than that inside the first opening 54, the valve member 98 opens the first opening 54 to allow a fluid to flow in. In the reverse case, the valve member 98 acts so as to prevent a fluid from flowing out. Thus, the valve member 98 functions the same as the check valve 60 in the electromagnetic valve shown in FIG. 3.

If the control unit stops applying a voltage to the solenoid 44, the valve member 98 is pressed against the valve seat around the first opening by means of a valve pressing member 106 (corresponding to the first valve member 76 of the electromagnetic valve in FIG. 3). Thus, the valve member 98 prevents a fluid from flowing in and out through the first opening regardless of the relationship between the pressure inside the first opening and that outside the first opening.

Therefore, in this electromagnetic valve, one valve member 98 is configured to serve both as the check valve 60 and the valve for opening and closing the first opening in the embodiment in FIG. 3, whereby it is possible to reduce the size and weight of the electromagnetic valve.

Figure 8:
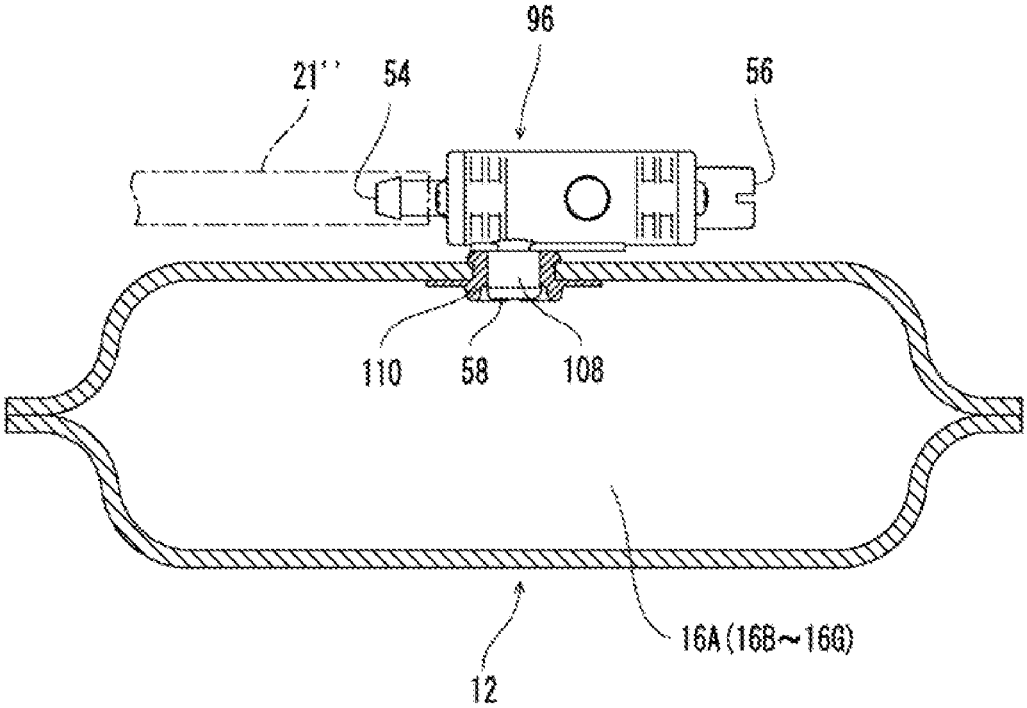
FIG. 8 is a partially sectional view showing a state in which the electromagnetic valve in FIG. 6 is disposed between the air chamber and a connector of the massage device.

FIG. 8 shows a state in which this electromagnetic valve 96 is attached to the massage device. The electromagnetic valve 96 in FIG. 8 is viewed from the same side as the electromagnetic valve in FIG. 3. The third opening 58 is connected directly to one of the air chambers of the massage device 12, the first opening 54 is connected to the branch portion 21" of the T-shaped connector (FIG. 2), and the second opening 56 is open to the atmosphere. As shown in the figure, the housing is provided, on the side wall thereof, with a tubular connecting protrusion 108 extending outwardly so as to define the third opening 58. The connecting protrusion 108 is inserted into a tubular connecting member 110 provided on a wall defining the air chamber, whereby the electromagnetic valve is communicated with and secured to the air chamber.

The invention claimed is:

1. A pneumatic massage apparatus comprising:

a pneumatic massage device comprising a plurality of air chambers configured to be expanded and contracted by supplying and discharging pressurized air thereto and therefrom so as to be capable of effecting a human body; and a pump configured to supply pressurized air to the air chambers, the pump being separated from the pneumatic massage device, wherein the pneumatic massage device is configured to be worn around an upper limb or a lower limb of a human body in a tubular manner, and the air chambers are arranged successively along a longitudinal direction of the tubular pneumatic massage device, the pneumatic massage device comprising:

a hose disposed so as to extend along the longitudinal direction and configured to receive at one end thereof pressurized air from the pump; and electromagnetic valves disposed at respective positions corresponding to the air chambers arranged successively along the longitudinal direction of the hose and being configured to control supply and discharge of the pressurized air to and from the air chambers, the electromagnetic valves each having a displaceable valve member with an armature, and a solenoid configured to attract the armature so as to move the displaceable valve member when a voltage is applied to the solenoid, wherein each of the electromagnetic valves includes a tubular housing having a longitudinal axis extending in the longitudinal direction of the hose, the tubular housing having an air inlet connected, along the longitudinal axis, to the hose at a first end, an air outlet open to the atmosphere at a second end, and a supply and discharge port on a side wall of the tubular housing connected to the air chamber corresponding to the electromagnetic valve, the supply and discharge port being selectively communicated with the air inlet or the air outlet by an opening and closing operation of the electromagnetic valve, wherein at least one pair of adjacent electromagnetic valves are arranged along the longitudinal direction of the hose, and air inlets of the pair of adjacent electromagnetic valves face each other, the at least one pair of adjacent electromagnetic valves having a first electromagnetic valve and a second electromagnetic valve, wherein connectors are configured and arranged so as to enable fluid communication between the hose and the air inlets of the electromagnetic valves, and wherein at least one of the connectors comprises a T-shaped connector having a base portion fluidly connected to the hose at an intermediate position between the pair of adjacent electromagnetic valves in the longitudinal direction of the hose, and extending in a direction perpendicular to the hose, and first and second branch portions extending from a distal end of the base portion in opposite directions along the longitudinal direction of the hose and fluidly connected to the air inlets of the first and second electromagnetic valves, respectively.

2. A pneumatic massage apparatus according to claim 1, wherein the electromagnetic valves are arranged such that the at least one pair of adjacent electromagnetic valves is one of a plurality of pairs of adjacent electromagnetic valves, the plurality of pairs of adjacent electromagnetic valves being arranged along the longitudinal direction of the hose, and each pair of adjacent electromagnetic valves includes first and second electromagnetic valves, and the first and second electromagnetic valves of each pair of adjacent electromagnetic valves are arranged such that air inlets thereof face other, and the at least one of the connectors is one of a plurality of connectors, each of the plurality of connectors comprising first and second branch portions of a T-shaped connector, and the air inlets of the first and second electromagnetic valves of each pair of electromagnetic valves are connected to the first and second branch portions of a respective T-shaped connector, respectively.

3. A pneumatic massage apparatus according to claim 1, wherein the tubular housings of the electromagnetic valves are aligned along a line parallel to the hose.

4. A pneumatic massage apparatus according to claim 1, wherein:

the side wall of the tubular housing comprises a tubular connecting protrusion protruding toward an outside of the tubular housing and defining the supply and discharge port; and the tubular connecting protrusion is inserted into and secured to a wall defining the corresponding air chamber to connect the supply and discharge port to the air chamber.

5. A pneumatic massage apparatus according to claim 1, further comprising:

an electromagnetic valve control unit for controlling the electromagnetic valves, the electromagnetic valve control unit being configured to gradually increase voltages applied to the solenoids to open or close the electromagnetic valves.

6. A pneumatic massage apparatus according to claim 5, wherein after the opening or closing operation of the electromagnetic valve, the solenoid is configured to have the voltage applied thereto to maintain a voltage value to maintain an open or close state of the electromagnetic valve.

7. A pneumatic massage apparatus according to claim 6, wherein the voltage value is less than a final voltage value applied for the opening or closing operation.

8. A pneumatic massage apparatus according to claim 7, wherein the electromagnetic valve control unit is configured to control the electromagnetic valves to supply and discharge the pressurized air to and from preselected air chambers.

* * * * *